US006727875B1

(12) United States Patent
Mikami et al.

(10) Patent No.: US 6,727,875 B1
(45) Date of Patent: Apr. 27, 2004

(54) HIGH-DEFINITION LIQUID CRYSTAL DISPLAY INCLUDING SUB SCAN CIRCUIT WHICH SEPARATELY CONTROLS PLURAL PIXELS CONNECTED TO THE SAME MAIN SCAN WIRING LINE AND THE SAME SUB SCAN WIRING LINE

(75) Inventors: Yoshiro Mikami, Hitachiota (JP); Hideo Satou, Hitachi (JP); Hiroshi Kageyama, Hitachi (JP); Yoshinori Aono, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 189 days.

(21) Appl. No.: 09/686,947

(22) Filed: Oct. 12, 2000

(30) Foreign Application Priority Data

Oct. 13, 1999 (JP) ..... 11-290584

(51) Int. Cl.[7] ..... G09G 3/36
(52) U.S. Cl. ..... 345/92; 345/93
(58) Field of Search ..... 345/87, 92, 90, 345/91, 93, 98, 100, 103; 349/48, 41, 42, 46, 33

(56) References Cited

U.S. PATENT DOCUMENTS 4,851,827 A * 7/1989 Nicholas ..... 345/93
5,165,075 A * 11/1992 Hiroki et al. ..... 349/48
5,926,160 A * 7/1999 Furuya ..... 345/98

* cited by examiner

*Primary Examiner*—Chanh Nguyen
(74) *Attorney, Agent, or Firm*—Antonelli, Terry, Stout & Kraus, LLP

(57) ABSTRACT

In a display matrix in which individual pixels in which a sub scan wiring and a display electrode, a main circuit of TFT controlled by an applied voltage of the main scan wiring and the sub scan wiring, and signal wiring and a display electrode are connected in series are arranged, and the sub scan wiring is arranged in the vertical direction, a line is selected and driven with the main scan pulse shifted sequentially in the individual frame time supplied on the main scan wiring, and with the sub scan pulse varying its state in a time of the main scan pulse.

2 Claims, 17 Drawing Sheets

FIG. 6

(a)

| G | Gs | | | |
|---|---|---|---|---|
| 1 | 1 | On | Off | On |
| 1 | 0 | Off | Off | Off |
| 0 | 1 | Off | Off | Off |
| 0 | 0 | Off | Off | Off |
| 0 | 1 | Off | Off | Off |
| 0 | 0 | Off | Off | Off |

(b)

| G | Gs | | | |
|---|---|---|---|---|
| 1 | 0 | On | On | On |
| 1 | 1 | Off | Off | Off |
| 0 | 0 | Off | Off | Off |
| 0 | 1 | Off | Off | Off |
| 0 | 0 | Off | Off | Off |
| 0 | 1 | Off | Off | Off |

(c)

| G | Gs | | | |
|---|---|---|---|---|
| 0 | 1 | On | On | On |
| 0 | 0 | Off | Off | Off |
| 1 | 1 | Off | Off | Off |
| 1 | 1 | Off | Off | Off |
| 0 | 1 | Off | Off | Off |
| 0 | 0 | Off | Off | Off |

(d)

| G | Gs | | | |
|---|---|---|---|---|
| 0 | 0 | On | On | On |
| 0 | 1 | Off | Off | Off |
| 1 | 0 | Off | Off | Off |
| 1 | 1 | Off | Off | Off |
| 0 | 0 | Off | Off | Off |
| 0 | 1 | Off | Off | Off |

HIGH-DEFINITION LIQUID CRYSTAL DISPLAY INCLUDING SUB SCAN CIRCUIT WHICH SEPARATELY CONTROLS PLURAL PIXELS CONNECTED TO THE SAME MAIN SCAN WIRING LINE AND THE SAME SUB SCAN WIRING LINE

BACKGROUND OF THE INVENTION

The present invention relates to a liquid crystal display apparatus, and, more particularly, to a liquid crystal display apparatus of the high resolution active matrix type.

Since an active matrix liquid crystal display apparatus can display images with a high contrast, and also has a low profile and is light in weight, it has been widely used for portable note-type computers and portable image display apparatuses. For example, this type of display apparatus is reported on pages 879 to 881 in the SAID International Symposium Digest of Technical Papers. A detailed description of the active matrix drive method and liquid display modules is found in "Liquid Display Technologies", Sangyo Tosho Publishing Co., authored and edited by Shouichi Matsumoto.

In order to provide an understanding of the difference between conventional devices and the present invention, a conventional display apparatus, as shown in FIG. 17, and the liquid crystal display apparatus of the present invention, as shown in FIG. 1, will be outlined below.

FIG. 1 is a schematic diagram of the present invention, in which the display areas 6, 7 are composed of a plurality of pixels 1, each arranged at a respective intersection between the main scan wiring lines 12 and the signal wiring lines 11, which are arranged in a matrix wiring configuration, and sub scan wiring lines 19 are arranged in the same direction as the signal wiring lines 11. In order to drive those wiring lines, a main scan circuit 10, a sub scan circuit 15, a signal circuit 9 and a control circuit 13 for controlling the control signals are provided, along with an opposed electrode 17 formed on the opposite substrate which faces the pixels and supports the liquid crystal. The electric power for driving this display apparatus, the synchronous signals and the display data are applied thorough a flexible wiring strip 14.

For driving an individual pixel, a couple of TFT's are connected between the drain wiring and the display electrode 2 and in series with the main circuit of the TFT, and the individual gate electrodes of the TFT's are connected to the main scan wiring lines and the sub scan wiring lines. A single main scan wiring line 12 is assigned to every two pixels of a column, and it is connected in common to the gate terminals of dual TFT's 3 for the main scan wiring. TFT's 4 for the sub scan wiring are arranged in a repetitive sequence of nch, pch, nch and pch in every column, and their gate terminals are connected to identical sub scan wiring lines in the row direction, and those lines are connected to one another outside the matrix, so that the TFT's are driven all together by the sub scan circuit 15. In addition, a retention capacitance 5 is arranged at the display electrode, and one terminal of the retention capacitance is connected to the display electrode, and its other terminal is connected to the terminal of an adjacent retention capacitance and is connected to the common electrode power supply circuit located outside the matrix.

In order to drive this matrix using a linear serial method, the following drive scheme is employed. At first, in order to select the pixels for every column, every two columns of TFT's 3 for the main scan wiring are turned on and two columns of pixels are selected by applying the main scan pulse to the main scan wiring; and then, the TFT for the sub scan wiring among the selected pixels in two columns is alternately turned on by setting the voltage of the sub scan wiring to logic level H for almost a half period of the main scan pulse and by setting logic level L for the remaining half period. The pixels arranged in a single column in which both the TFT 3 for the main scan wiring and the TFT 4 for the sub scan wiring are simultaneously turned on can be selected.

In the display apparatus with a conventional structure, as shown in FIG. 17, the pixel TFT 102 is arranged at the intersection of the scan wiring line 100 and the signal wiring line 101, with the main circuit of the TFT being connected between the signal wiring line 101 and the display electrode 103 and the scan wiring line 100 being connected to the gate electrode of the TFT. In this case, the number of scan wiring lines is required to be equal to the number of pixels arranged in the column direction. As the selection pulse is applied sequentially to the scan wiring line from the first column, the pixel of the first column is selected by turning on the pixel TFT of the first column and the liquid crystal capacitance composed of the display electrode 104 and the opposed electrode 105 is charged by the signal voltage of the signal wiring line 101; and then, the pixel TFT of the first column is turned off, and next, the second and remaining columns are repetitively driven so as to be selected, until all the scan wiring lines are scanned, and the display operation is completed by applying a designated signal voltage to all the pixels.

In an attempt to provide a panel that is configured with a higher resolution in the conventional technology, the selection time, that is, the gate time for a single pixel is reduced because the number of the scan wiring lines increases. Thus, a speeding up of the response in the scan wiring is required. However, as the number of pixels for a single column inevitably increases for attaining the higher resolution, the wiring time constant represented by the product of the wiring resistance and the wiring capacitance increases and the transition response time at the terminal of the wiring increases. In attempting to speed up the transient response, though there may be an alternative way in which the wiring resistance is made smaller, a modification of the process is required, which is not feasible realistically. In addition, though there may be an alternative way in which the wiring width is made larger in order to reduce the wiring resistance, this results in a decrease in the numerical aperture of the pixel part and an increase in the electric power consumption of the panel itself.

The present invention is characterized in that, by combining the main scan pulse generated by the main scan wiring lines arranged in the row direction and the sub scan pulse generated by the sub scan wiring lines arranged in the column direction along the signal wiring lines, a pixel line is selected by a TFT circuit formed at the pixel part. By applying a pulse having a time width twice as long as the selection time for the individual column to the main scan wiring lines having a long wiring delay time, and by applying a high-speed sub scan pulse to the sub scan wiring lines having a wiring length in the row direction, a single row can be selected. With this configuration, the pulse width of the wiring selection pulse can be extended to be twice as long as that in the prior art even in a panel with high definition, and an excellent display image can be obtained even if the wiring response time may increase.

In accordance with the present invention, if the number of sub scan wiring lines is defined to be "a", the selection time width of the main scan wiring can be extended "2a" times, and the main scan wiring pulse width can be extended four times, eight times or sixteen times by making the number of the sub scan wiring lines two, three or four, which leads to an advantageous aspect for making it easier to form a high-definition panel.

In addition, according to the present invention, the extension of the main scan wiring pulse width may contribute advantageously to the reduction of the frequency and energy of the unnecessary radiation generated from the main scan wiring.

And, furthermore, by applying this drive method to a reflection liquid crystal display apparatus, a high-definition and low electric power consumption panel can be advantageously provided.

As for the method in which plural TFT's for pixel selection are formed in a pixel, there is a case as disclosed in Japanese Patent Application Laid-Open No. 9-329807 (1997). A couple of TFT's are connected between the display electrode and the signal wiring line by connecting the main circuit of the TFT's in series and arranged in a single pixel, and its gate terminals are connected to a scan wiring line and a block selection signal wiring line, respectively. However, with this arrangement, the scan wiring line is extracted for an individual column and the width of the scan pulse is identical to that in the prior art described above. In addition, a pixel is selected by a unit for the block defined in the horizontal direction, in which its expected effect is to reduce the electric power consumption for driving the display panel for animation display without driving the pixel which does not require data writing, and thus, its structure and effect is completely different from that of the present invention.

In order to make the characteristic of the present invention clear, the time relation with respect to the drive condition of the scan wiring in the prior art will be described below. The frame frequency corresponding to the period while scanning the whole display panel is defined to be 60 Hz or higher. This frequency is required for reducing the flicker on the display panel. The relation between the frame time and the selection time for a single scan wiring line is given by the following approximate equation.

$$Tg=1\ (f\times N),$$

in which Tg is the selection time for the single scan wiring line, f is a frame frequency and N is the number of the scan wiring lines. The minimum frame frequency is 60 Hz, and N represents the definition of the panel which is often 480, 600 or 768 for a note-type computer, and is often 1024 or 1200 for a large-sized panel such as used for a desk-top computer. The selection time decreases reciprocally as N increases. For example, Tg is 30 $\mu$sec for N=480, and Tg is 14 $\mu$sec for N=1200. As the number of the scan wiring lines increases, the number of pixels in the horizontal direction in the pixel area, that is, the number of rows in the display matrix increases in proportion to the number of scan wiring lines. As the aspect ratio of the display area is 3 to 4 in the display apparatus to be used for a personal computer, the pixel structure in terms of pixels in the horizontal direction by pixels in the vertical direction is from 640 pixels×480 pixels to 1600 pixels×1200 pixels.

As described above, in the conventional liquid crystal display apparatus, as the number of pixels connected to a single scan wiring line inevitably increases in response to provide the display matrix with a high resolution, the wiring capacitance increases and the transient response time of the main scan wiring increases. In contrast, there is a conflict in that the selection time for a single pixel becomes shorter, and the response of the main scan wiring line should be improved for speeding up the operation.

In the recent trend in multimedia technologies, a high resolution display capability for the display apparatus used in personal computers is an indispensable requirement, and high resolution compliance is an important goal to be achieved.

SUMMARY OF THE INVENTION

An object of the present invention is to provide a liquid crystal display apparatus that enables high-definition display images without decreasing the selection time of the main scan time, even if the pixel part is configured to provide a high resolution.

Another object of the present invention is to provide a liquid crystal display apparatus in which, by making the time width of the scan pulse larger, a high display quality can be obtained even if the output resistance of the main scan circuit for driving the main scan wiring is high and the drive performance is low, and in which the transistor area of the output stage can be reduced and the circuit width can be reduced.

Another object of the present invention is also to provide a liquid crystal display apparatus in which, by making the selection time of the main scan wiring and the signal wiring longer, the output accuracy of the signal circuit is improved and a high resolution display can be established with higher accuracy in the gradation sequence.

In order to attain the above objects, in accordance with the present invention, a couple of TFT's are connected to the signal wiring line and the display electrode by connecting the main circuit of the TFT's in a series connection, one of the gate electrodes of two TFT's is connected to the main scan wiring line formed as one line for every two pixels, and the other of the gate electrodes of two TFT's are connected to the sub scan wiring line formed as one line for every single signal wiring line, and the main scan wiring line is driven with a scan pulse having a width that is twice as long as the width of the selection time for a single column by the single main scan wiring line formed for every two columns and a single sub scan wiring line, which leads to an excellent display quality.

In order to attain another object, in accordance with the present invention, three TFT's are connected to the signal wiring line and the display electrode by connecting the main circuit of the TFT's in a series connection. A single main scan wiring line is assigned to four columns of pixels, in which the polarity of the pixel TFT is defined by a repetitive and cyclic use of patterns, Nch-Nch-Nch, Nch-Nch-Pch, Nch-Pch-Nch and Nch-Pch-Pch. Each Nch device at the gate electrodes of the first one of the three TFT's is connected in common to the main scan wiring line. For the other two TFT'S, the second ones have their gate electrodes connected to each other and the third ones have their gate electrodes connected to each other, then each is connected individually to two sub scan wiring lines. With this configuration, the voltage relation of two sub scan wiring lines for four columns of pixels connected to a single man scan wiring lines produces four states, H-H, H-L, L-H and L-L, and one of the columns among them can be selected sequentially. In this case, even if the main scan wiring line is driven with a scan pulse having a width four times longer than the width of the selection time for a single column, an excellent display quality can be obtained.

In order to attain another object, in accordance with the present invention, a couple of signal wiring lines are formed for an individual row, and two columns are selected at one time and operated for writing. As the scan pulse width is eight times longer than the width of the selection time for a single column, and the writing time for the signal voltage can be spent twice, the accuracy in writing the signal voltage can be increased and the display quality can be increased to a large extent.

BRIEF DESCRIPTION OF THE DRAWINGS

FIGS. 6(*a*) to 6(*d*) are explanatory diagrams of the selection status.

DETAILED DESCRIPTION OF THE PREFERRED EMBODIMENTS

Figure 1:
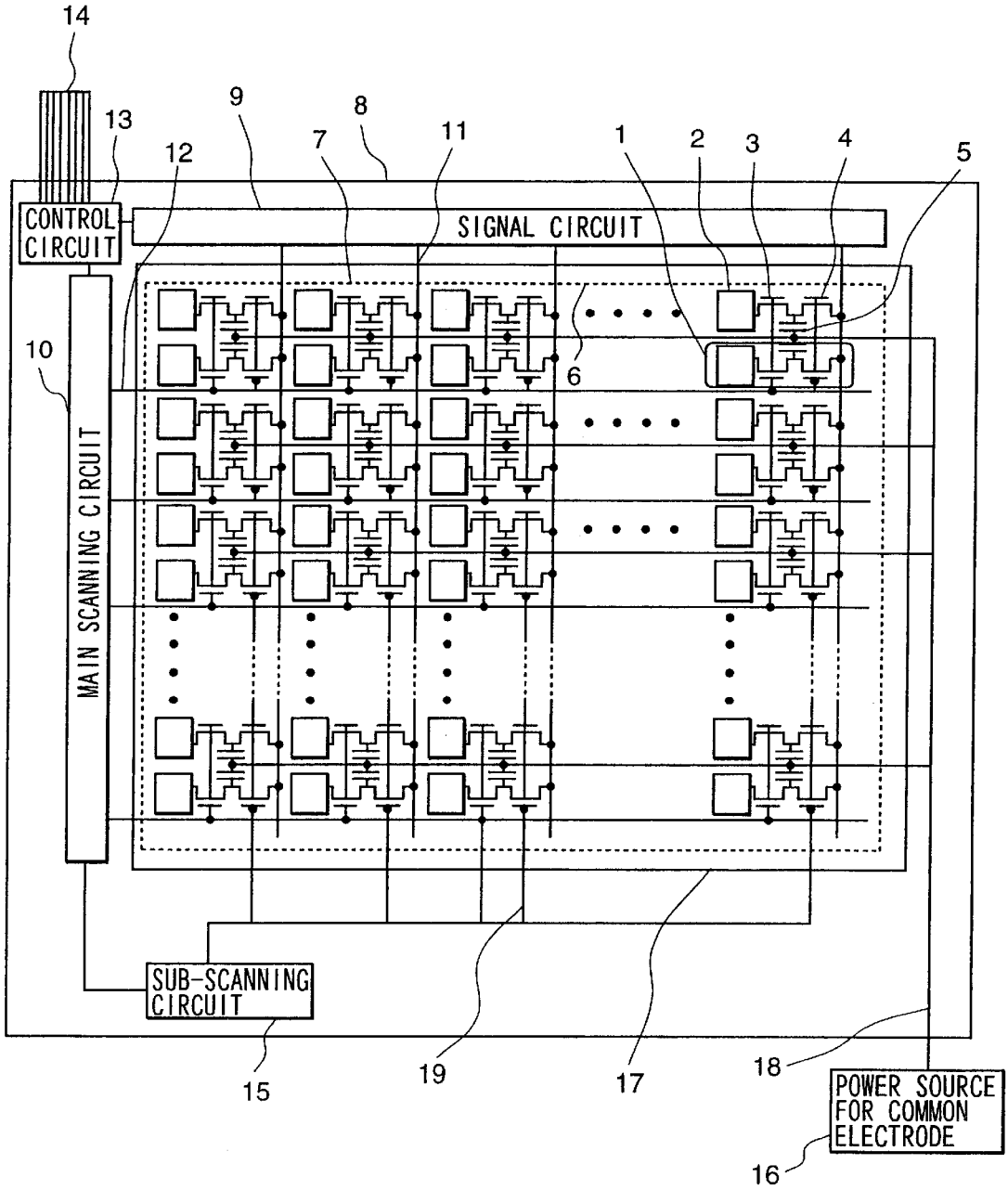
FIG. 1 is a schematic plan view showing an outline of the structure of a display panel in accordance with the present invention.

The first embodiment of the present invention now will be described with reference to FIG. 1, which shows an outline of the structure of a liquid crystal display apparatus in accordance with the present invention.

In display areas 6, 7 of the liquid crystal display apparatus of the present invention, plural pixels 1 are arranged on the glass substrate 8 in a matrix arrangement. There is also provided a main scan circuit 10, a signal circuit 9, and a sub scan circuit 15, all for driving the matrix wiring, and a control circuit 13 is provided for controlling the operation timings for those circuits. Furthermore, the liquid crystal display apparatus includes wiring line 18 for connecting to the common electrode power supply circuit 16 arranged outside the glass substrate 8 and wiring lines 14 for supplying the electric power, the timing signals and the display data to the liquid crystal display apparatus.

The display areas 6 and 7 have a matrix structure of N columns and M rows. This matrix wiring arrangement is composed of one main scan wiring line 12 for each two columns, a signal wiring line 11 and a sub scan wiring line 19 arranged along the direction of the signal wiring line. The inside of the pixel 1 is composed of a display electrode 2, a TFT 3 for the main scan wiring line, a TFT 4 for the sub scan wiring line and an additional capacitance 5. The signal wiring line 11 and the display electrode 2 are connected to each other by the main circuit for TFT 3 for the main scan wiring line and TFT 4 for the sub scan wiring line formed by connecting the main circuit thereof between the source and the drain. The gate electrode of the TFT 3 for the main scan wiring line is connected to the main scan wiring line 12 and the gate electrode of the TFT 4 for the sub scan wiring line is connected in common for every row to the sub scan wiring line 19 and is connected together to the sub scan circuit 15 outside the matrix.

As for TFT 3 for the main scan wiring line, a Nch TFT is used for all the pixels, and as for the TFT 4 for the sub scan wiring line, a sequence composed of Nch, Pch and Nch is repeated from the first row to the final row so that the polarity may be altered for every row.

One end of the additional capacitance 5 is connected to the display electrode 2 and its other end is commonly connected to the common wiring line 18 arranged to be parallel to the main scan wiring line 12 and extends outside the matrix and is connected to the common electrode power supply circuit 16.

Though it is not shown in FIG. 1, there is an opposed glass substrate on which an opposed electrode 17 is formed so as to face the glass substrate 8, and the liquid crystal is supported between those glass substrates. A polarizing plate is arranged outside those substrates, and, furthermore, light sources, such as a fluorescent back light and an EL device, are arranged behind the glass substrate 8, all of which are a part of the components of the liquid crystal display apparatus.

In the pixel 1, the TFT 3 for the main scan wiring line in two columns are turned on all together by the scan pulse supplied from the main scan circuit 10, and the individual sub scan TFT's with Nch and Pch are selectively turned on depending on whether the sub scan voltage is H or L. By making the level of the sub scan voltage H during half the period of the scan pulse width from the main circuit and making it L during the remainder of the period, the pixels at the first column and the second column are selected exclusively.

Next, the planar structure of the pixels will be described with reference to FIG. 2.

Figure 2:
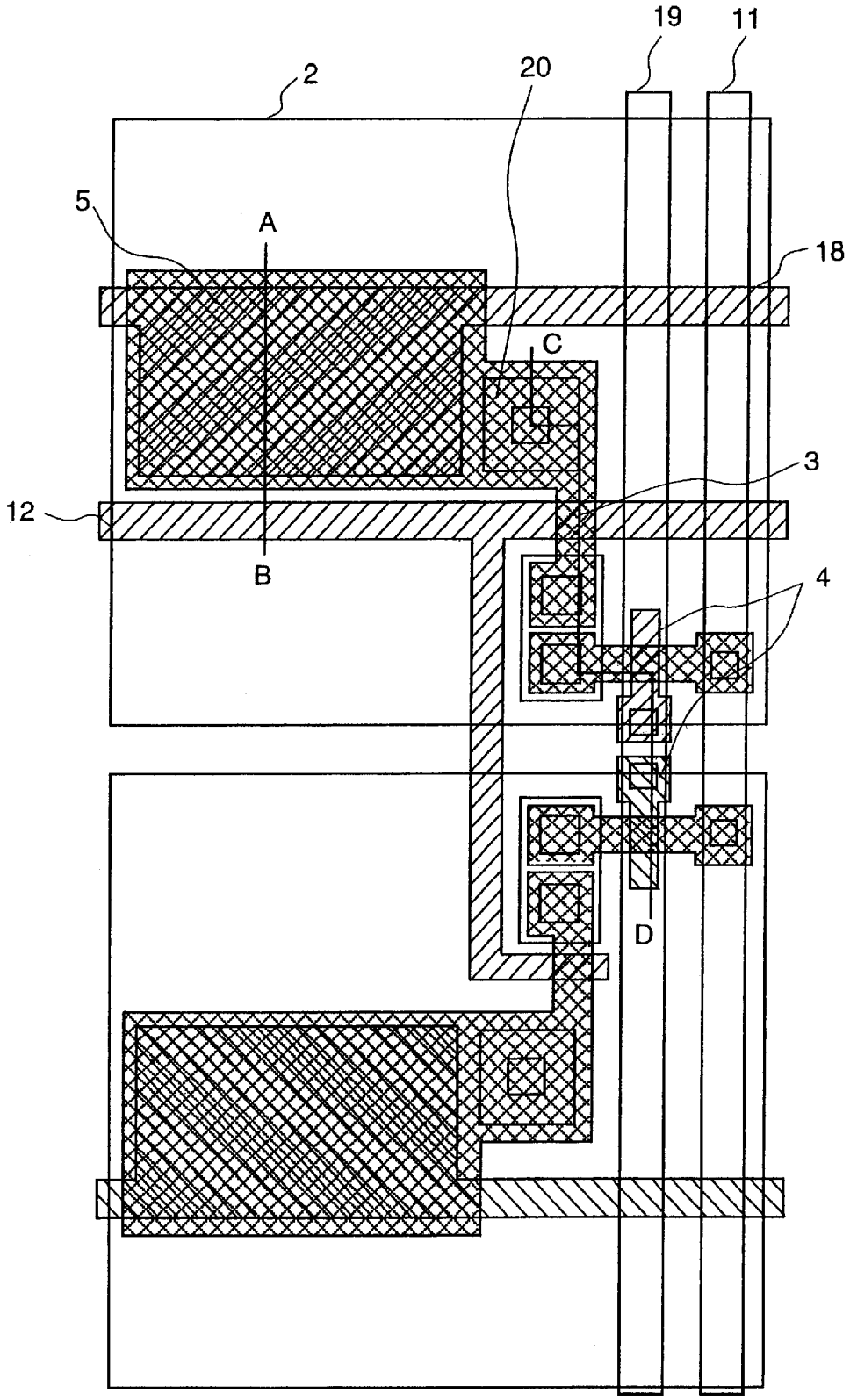
FIG. 2 is a plane view of the pixel part.

In FIG. 2, the pixels on the first line and the second line are shown together. The display electrode 2 composed of ITO, the signal wiring line 11 shaped as a vertical stripe, the sub scan wiring line 19, the main scan wiring line 12 and the common wiring line 18 are arranged so as to mutually connect the pixels adjacent to one another in the vertical direction. The signal wiring line 11 and the display electrode 2 are connected through TFT 4 for the sub scan wiring and through TFT 3 for the main scan wiring via the display electrode connection part 20.

In FIG. 2, the upper side of TFT 4 for the sub scan wiring is Nch, and the lower side of TFT 4 for the sub scan wiring is Pch. With this structure, by switching the voltage of the single sub scan wiring 19 between the level H and the level L, the upper pixel and the lower pixel in FIG. 2 can be selectively driven. In the case where a couple of TFTs 4 for the sub scan wiring are composed individually with nch or pch, this structure can be realized by forming a couple of sub scan wiring lines individually independent of each other without sacrificing the principle of the present invention. In addition, the additional capacitance 5 is formed by using an Si layer composing TFT 3 for the main scan wiring linen and the gate electrode layer as its electrodes and by using the gate insulating layer as its insulating layer.

The process for forming the pixel part can be established if thin film transistors only composed of CMOS, or nch and pch, and the two-layered metallic thin film wiring enabled to form intersection wiring can be developed on the glass substrate, which can be formed by a thin film transistor having a CMOS structure using polycrystalline silicon developed on the glass substrate. In addition, as described above, the pixel part can be established by only using an nch TFT, and also with processing with a reversed stagger structure a-Si TFT.

Figure 3:
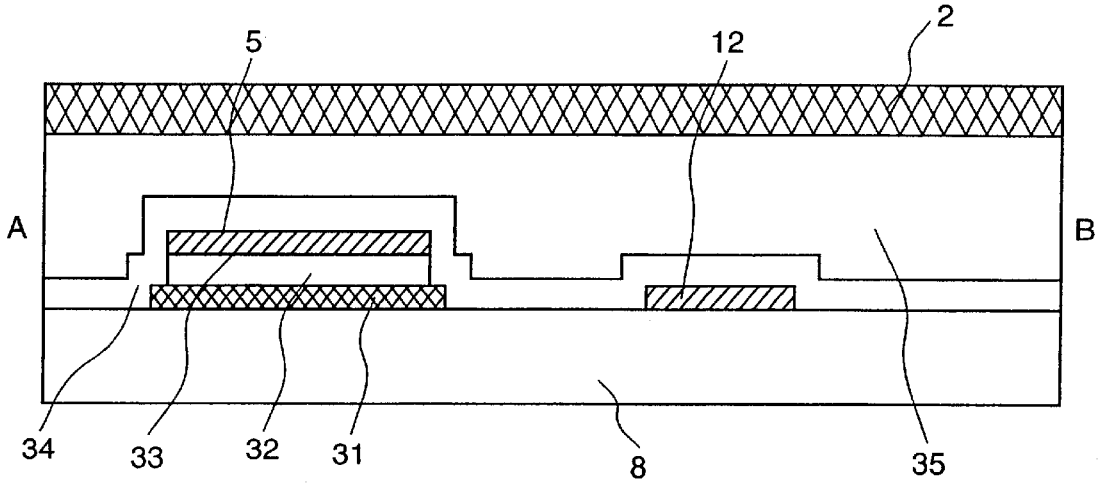
FIG. 3 is a cross-sectional view of the pixel capacitance part, as seen along line A–B in FIG. 2.
Figure 4:
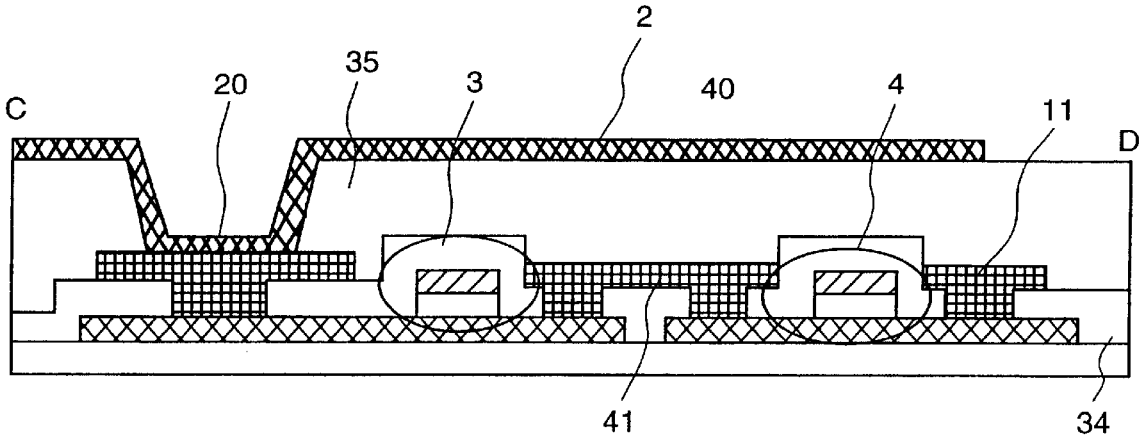
FIG. 4 is a cross-sectional view of the junction part of the TFT display electrode, as seen along line C–D in FIG. 2.

Next, the cross-sectional structures at the A–B line and C–D line as the main parts in FIG. 2 will be described with reference to FIG. 3 and FIG. 4, respectively. FIG. 3 is a cross-sectional view of the additional capacitance and the main scan wiring part. In the additional capacitance part, the capacitance is established by a laminated structure including an island shaped Si layer 31, a gate insulating layer 32 and a gate electrode layer, and the display electrode 2 is formed with ITO by laminating the insulating layer 34 between inorganic layers and the organic insulating layer 35. The main scan wiring is formed by using the gate electrode layer 33 on the glass substrate.

Next, the cross-sectional structure at the C–D part in FIG. 2 will be described with reference to FIG. 4. The signal wiring line 11 is formed by using the metallic wiring layer 40 composed of Al and so on from the gate insulating layer to the insulating layer 34 between inorganic layers. It is connected to the drain part of the sub scan TFT 4, and then, it is connected to the drain part of the main scan TFT 3 through the source part and the connection part 41. The source part of the main scan TFT is connected through the metallic wiring layer 40 and the connection part 19 as an open part of the inorganic insulating layer 35 to the display electrode 2.

Figure 5:
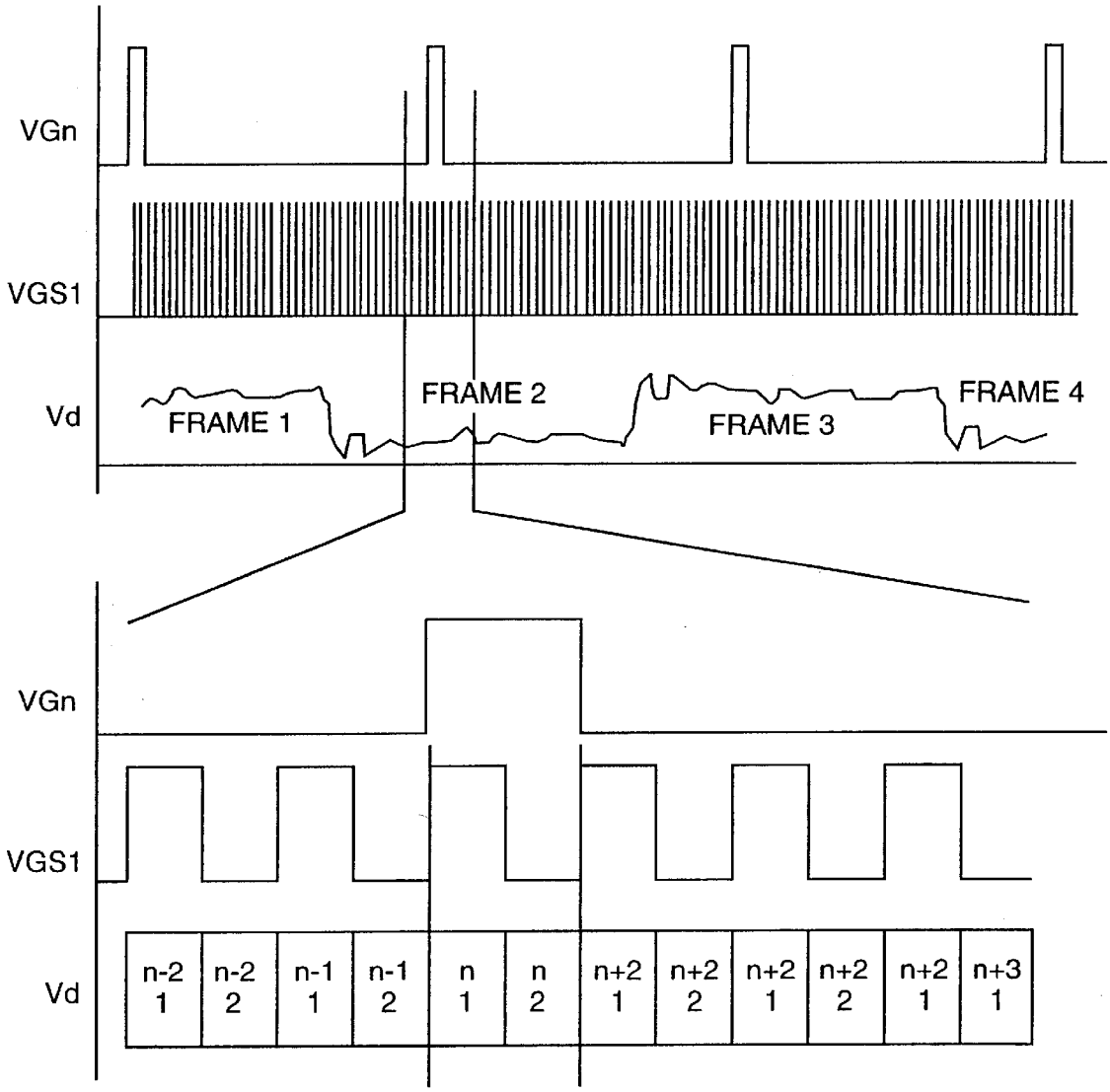
FIG. 5 is a diagram showing waveforms of driving signals for the individual parts.

Next, the operation of the pixel part in FIG. 5 will be described with reference to the drive signal waveforms. VGn represents the wave form of the main scan, VGS1 represents the waveform of the sub scan, and Vd represents the signal waveform. A pulse is applied to the main scan signal waveform every frame cycle. The polarity of the signal waveform is reversed every frame, and it drives the liquid crystal of the pixel part in the AC mode. The lower half in FIG. 5 is a magnified view of the single pulse of the main scan signal waveform in the second frame cycle. The sub scan pulse with its pulse width being half the pulse width of the main scan signal waveform is repetitively applied to the sub scan wiring. The pixel on the (n−1)th column of the sub scan TFT is nch, and the pixel on the (n−2) th column is pch. In order to drive the pixels on the (n−1)th column to the (n−2)th column connected to the arbitrary nth main scan wiring line, a selection pulse at the H level is applied to the nth main scan wiring line. In this cycle, the main scan TFT including the pixels on the (n−1)th column and the (n−2)th column are turned on. In this cycle, in applying the sub scan pulse to the sub scan wiring line, since the sub scan TFT 4 on the (n−1)th column is nch in the cycles, while the H level is held, the TFT is conducting. Since the main scan TFT 3 and the sub scan TFT 4 connected in series to each other are turned on in the (n−1)th column, the signal voltage n1 on the signal wiring line is applied to the display electrode. As the sub scan TFT 4 is turned off in the (n−2) th column, the voltage to the display electrode is not changed. Next, when the sub scan signal turns to the L level, both of the TFT's of pixels on the n−th column are turned on, and then the voltage state of the signal wiring line for n2 is loaded onto the pixel. Thus, the pixels for the single column can be selectively driven simultaneously by the main scan line with a pulse width equivalent to two columns. The relationship between the logical value of the scan signal waveform and the selected column are shown in FIG. 6. G represents the logical value for the main scan wiring line, and Gs represents the logical value for the sub scan wiring line. The pixels for every two columns are connected to the main scan wiring line, in which the sub scan TFT 4 of the pixels on the odd numbered columns, for example, the $1^{st}$, $3^{rd}$ and $5^{th}$ columns, are Nch, and the sub scan TFT 4 of the pixels on the even numbered columns, for example, the $2^{nd}$, $4^{th}$ and $6^{th}$ columns, are Pch. Thus, in a case where Gs=H, the pixels on the odd numbered columns are selected, and in the case where Gs=L, the pixels on the even numbered columns are selected. Since the main scan TFT 3 is nch, it is selected only in case GS=H. Therefore, the pixels for the odd numbered columns are selected in case G=Gs=H, and the pixels for the even numbered columns are selected in case G=H and Gs=L. Therefore, by applying the pulses with logical conditions being transitive as shown in the figure, the pixels are selected from the first column in the order from (a) to (d) in FIG. 6.

Figure 13:
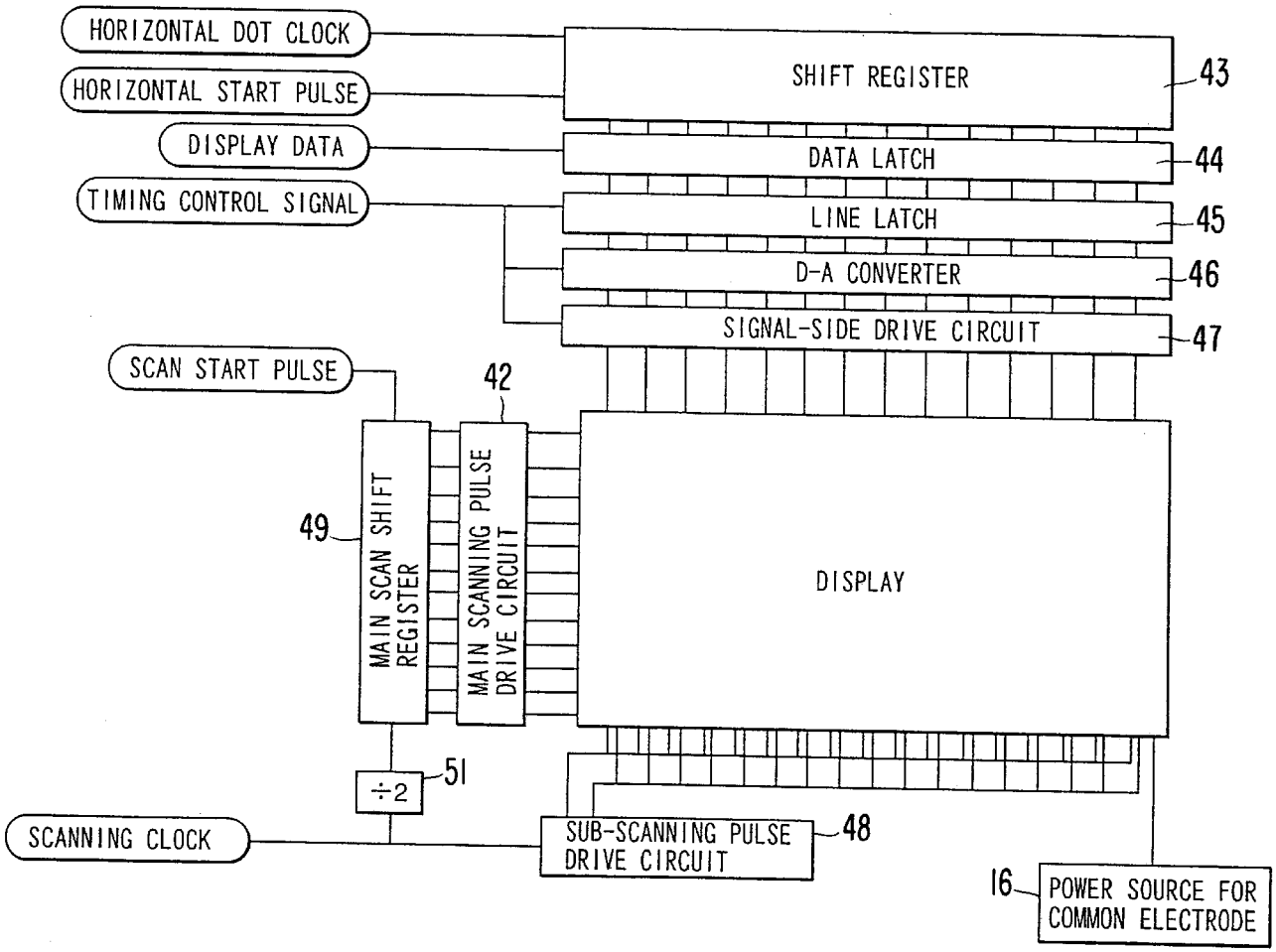
FIG. 13 is a block diagram of a liquid crystal display apparatus.

The circuit configuration of the liquid crystal display apparatus using the driving method for the display matrices in this embodiment is shown in FIG. 13. The structure of peripheral circuits for driving the display part composed of the display matrix arrangement of pixels is shown. The control signal required for driving the display apparatus uses a horizontal dot clock and digital display data synchronized with this clock, and the horizontal start pulse synchronized with the start timing in the horizontal direction. In addition, in order to control the timing for the vertical direction on the display screen, the display operation is controlled by the scan start pulse synchronized with the frame start signal and the scan clock synchronized with the vertical scan time.

The structure and operation of the main scan circuit 10 shown in FIG. 1 is described below. The main scan shift register 49 comprising shift registers connected in a multi-stage topology is driven by the main scan shift clock obtained by the frequency divider circuit 51 dividing the scan clock with its timing adjusted so as to be synchronized to the scan start pulse by the timing control circuit 50. The output impedance of the output from each state is reduced by the main scan pulse drive circuit 42, and then its output drives the main scan wiring. The main scan pulse drive circuit is composed of a general level shifter and an output buffer.

In the sub scan circuit 15 in FIG. 1, the impedance of the output from the timing control circuit is reduced by the sub scan pulse drive circuit 48, comprising a general level shifter and an output buffer, and its output drives the sub scan wiring. The common electrode power circuit 16 in FIG. 1 is composed of a DC power circuit, and it keeps the voltage of the common electrode constant.

As shown in FIG. 13, the signal circuit in FIG. 1 is composed of the shift register 43 connected in series to the multistage shift register circuits, the data latch 44 comprising a memory circuit for capturing the display data for a single column with sampling signals dot by dot, and performing a holding operation, the line latch 45 comprising a memory circuit for storing the data for a single column all together, D-A converter circuit 46 for converting the digital data to the liquid crystal gradation voltage, and the signal drive circuit 47 for driving the signal wiring at a high speed with lower impedance, and this signal circuit operates as described below.

By using the output from the individual state of the shift register 43 driven by the horizontal dot clock and the horizontal start pulse as a sampling signal, the data latch circuit 44 arranges and holds the digital display data for a single column among the display data supplied serially. This digital display data for the single column is transferred to the line latch 45 by the line latch signal input as a timing control signal at the timing when the transfer of data for the single row is terminated. In response to the data at the line latch, D-A converter circuit 46 generates the liquid crystal drive voltage based on the display data defined for the individual pixels. The impedance of the output is reduced by the signal drive circuit 47 and the output drives the signal wiring. As described above, the main scan pulse and the sub scan pulse are provided by controlling the scan clock in synchronization with the line latch signal of the signal circuit, and then, the desired display image can be obtained.

Next, a second embodiment will be described.

Figure 7:
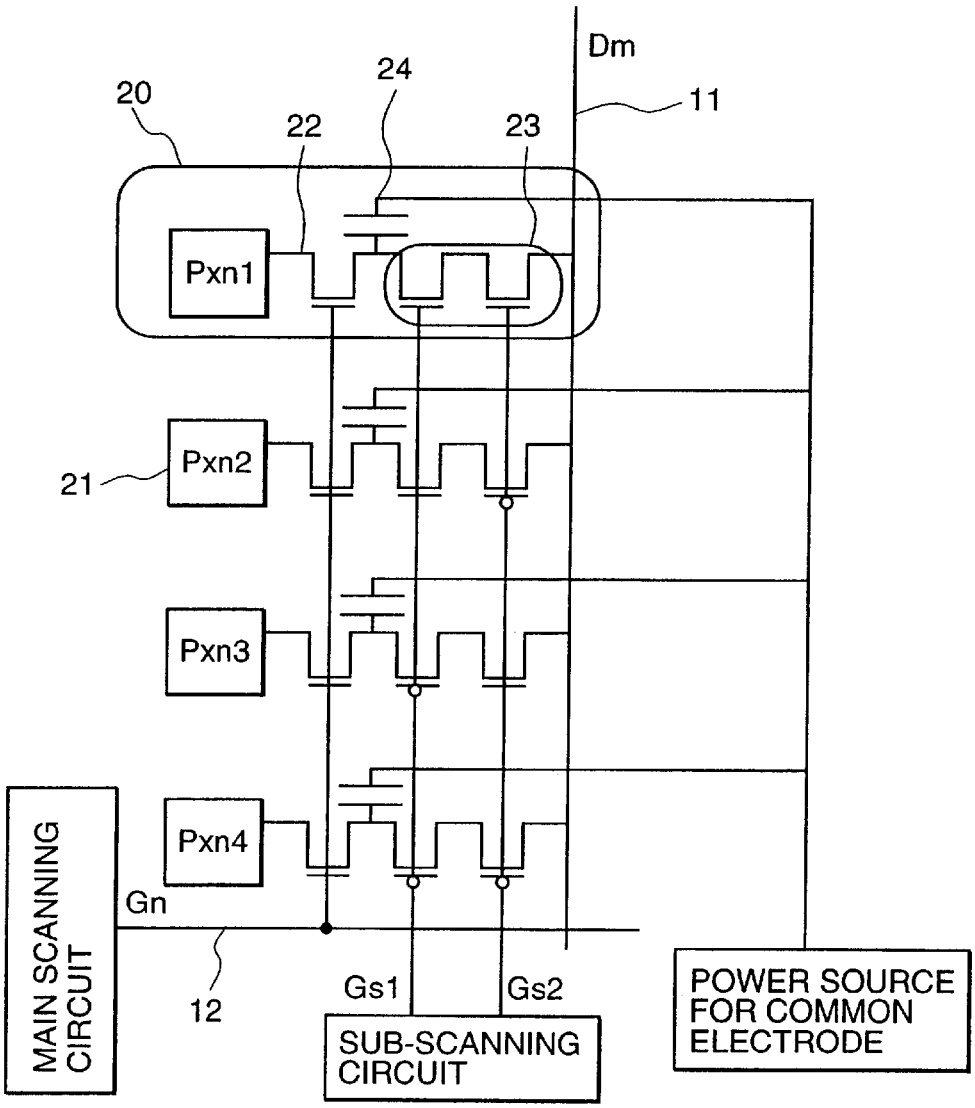
FIG. 7 is a schematic diagram showing a pixel circuit in a second embodiment.

The circuit structure at the pixel part is shown in FIG. 7. In FIG. 7, what is shown is a structure in which 4 columns of pixels are connected to the single main scan wiring line 12. In the individual pixel 20, Nch TFT 22 for the main scan wiring line and a couple of TFT's 23 for the sub scan wiring lines are arranged between the display electrode 21 and the common signal wiring line 11, and the individual gate is connected to the main scan wiring line 12 and to a couple of sub scan wiring lines Gs1 and Gs2. In addition, one end of the additional capacitance 24 is formed at the display electrode 21, and its other end is commonly connected to the common electrode power supply circuit 16.

The pair of TFT's 23 assigned to each individual pixel are arranged for the individual four columns with the combinations of nch and nch, nch and pcn, pch and nch, and pch and pch. With this configuration, by combining the logic generated with a couple of sub scan signals, a single pixel can be selected and driven among four pixels. By combining the logic generated by the main scan wiring line and the logic generated by the sub scan wiring lines, a designated single column is selected among all the pixels, and then the signal wiring voltage can be applied to the pixel.

Figure 8:
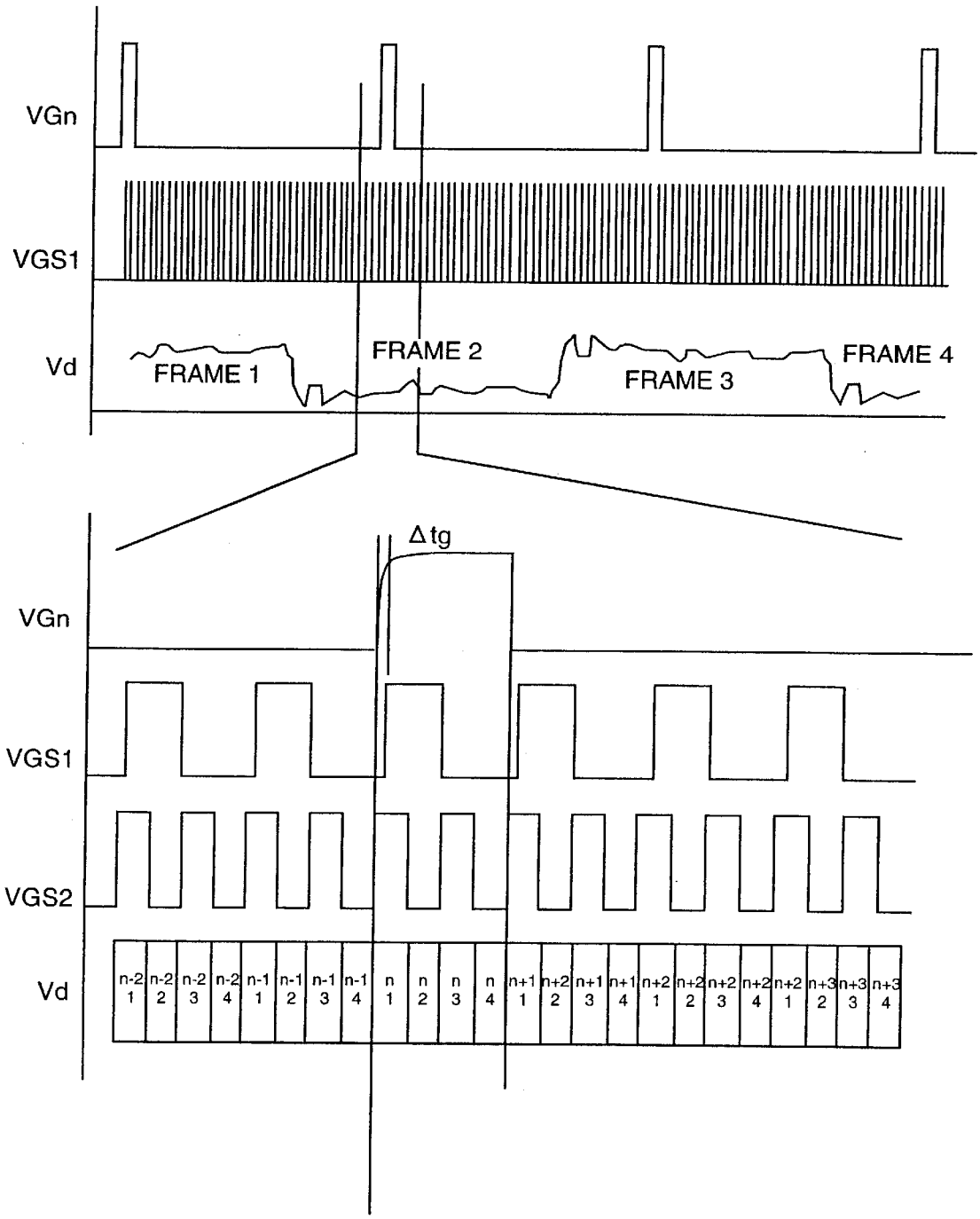
FIG. 8 is a diagram showing waveforms of driving signals for the individual parts in the second embodiment.

The operation of this circuit will be described with reference to the drive signal waveform shown in FIG. 8. VGn is a scan signal waveform to be applied to the nth main scan wiring line, VGS1 and VGS2 are sub scan signal waveforms to be applied to the sub scan wiring lines GS1 and GS2, respectively, and Vd is a signal waveform to be applied to the m-th signal wiring line. As for the main scan signal waveform, a single pulse is applied every frame cycle. The polarity of the signal waveform is reversed for every frame, and this signal drives the liquid crystal of the pixel part with an AC mode. The lower half in the figure is a magnified view of the single pulse of the main scan signal waveform in the second cycle of the frame. The sub scan pulse with its width being approximately half of the main scan signal waveform is applied repetitively to the sub scan wiring VGS1, and the sub scan pulse with its width being a quarter of the main scan signal waveform is applied repetitively to VGS2. By applying the selection pulse at the H level to the main scan wiring line, the main scan TFT's at the pixels from the pxn1st to the pxn4th columns are turned on. In this period, by applying the sub scan pulses with four different combinations of H level and L level, having the states H, H, H, L, L, H, L and L, sequentially to two sub scan wiring lines GS1 and GS2, both of two sub scan TFT's are selectively turned on at the pixels from Pnx1 to Pnx4, and the signal voltage Vd is selectively applied to the individual display electrodes, so that a the designated pixel electrode can be driven. Since a response delay tg occurs due to the wiring resistance and the wiring capacitance at the actual display panel, and especially as the wiring length of the main scan wiring becomes longer, the delay becomes dominant. Since this delay time reduces the effective selection time for the pixel, it will be appreciated that a sufficient time for driving the pixel can be obtained by providing a time delay at the rising of the main scan pulse and the sub scan pulse even of a delay occurs, and thus, an excellent display image can be established. For a similar reason, it is possible to define the time difference for enabling the sub scan pulse to respond when the main scan pulse falls.

Figure 9:
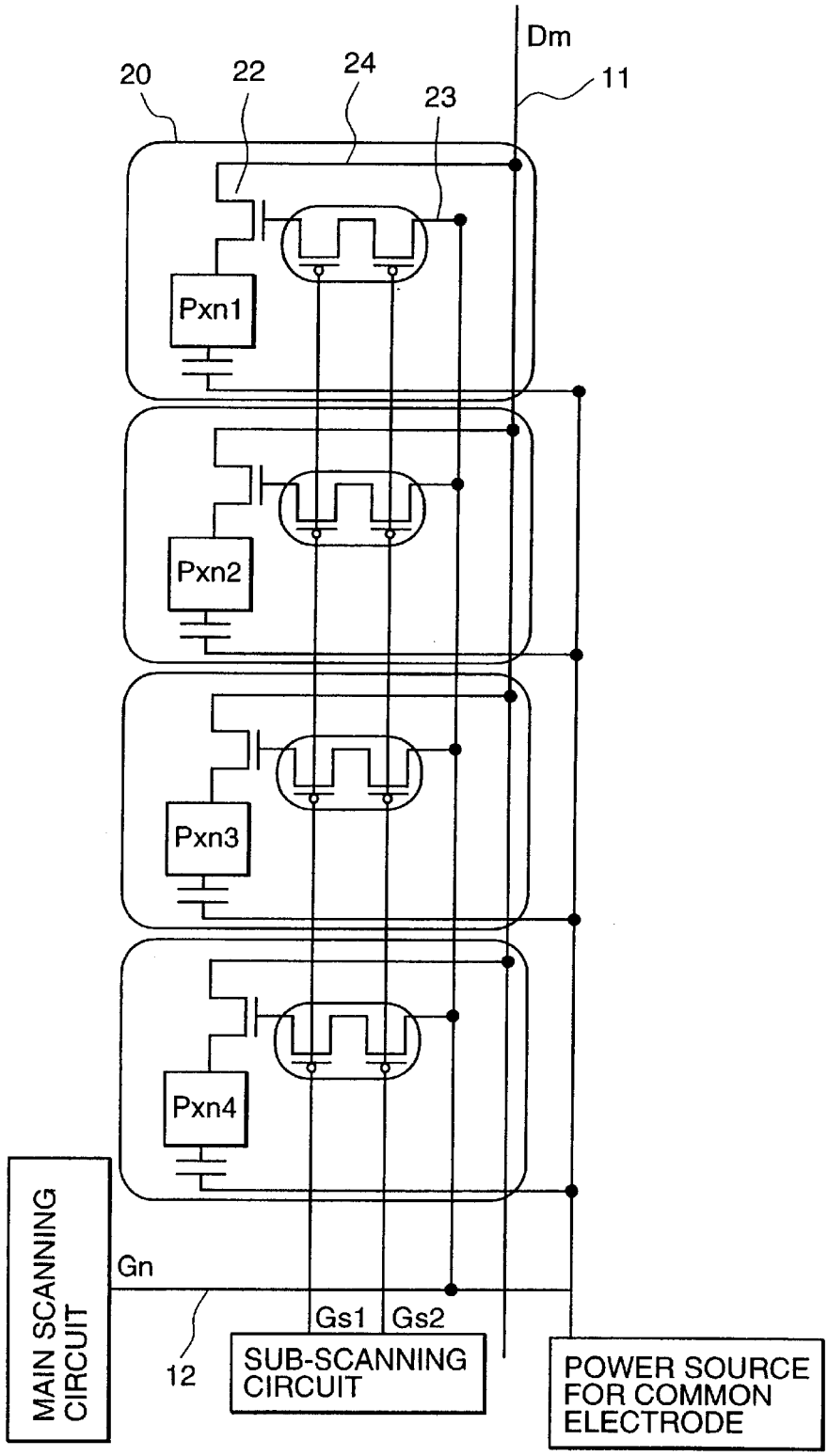
FIG. 9, FIG. 10 and FIG. 11 each is a diagram showing a pixel circuit in a third embodiment.
Figure 10:
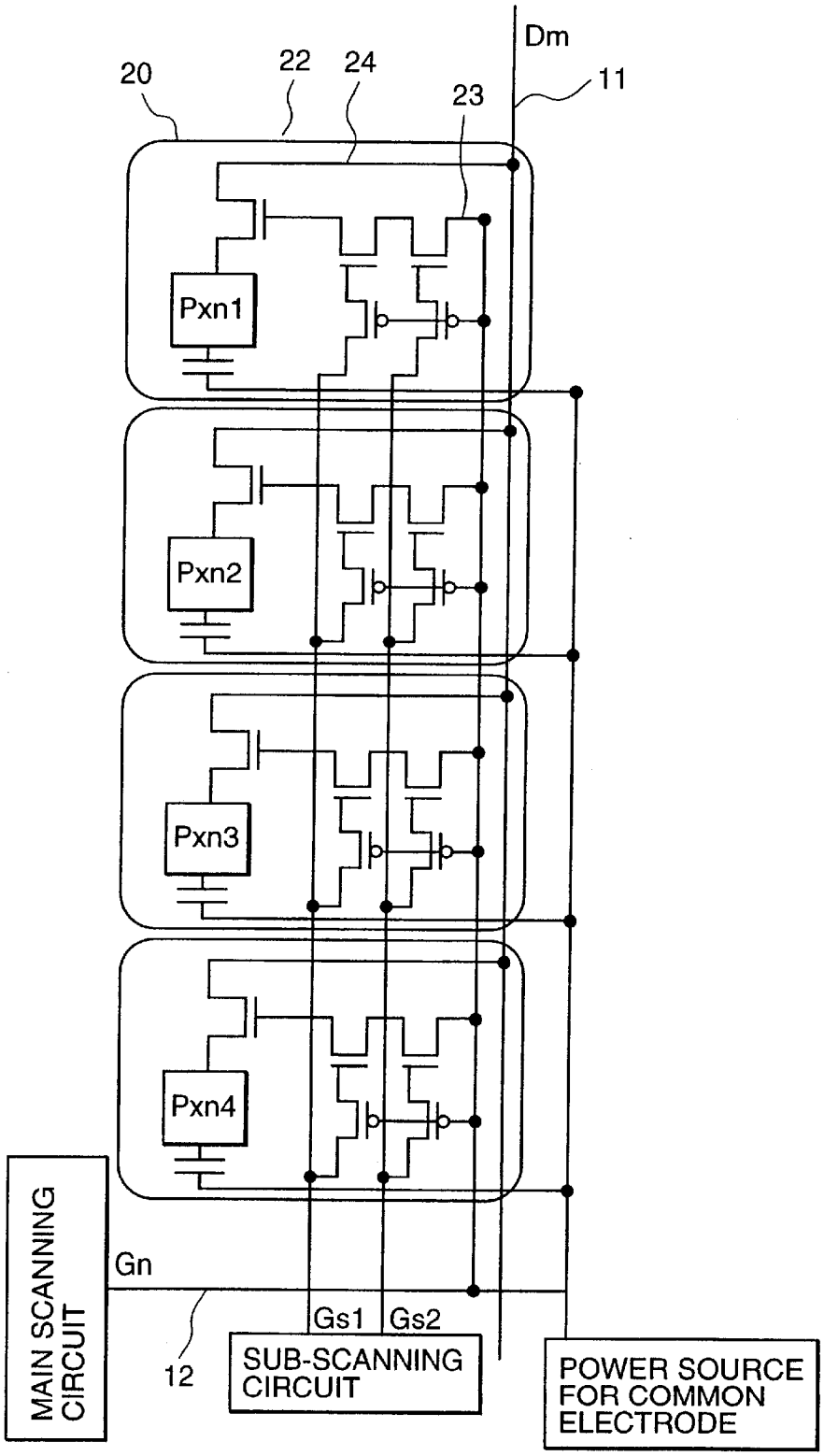
Figure 11:
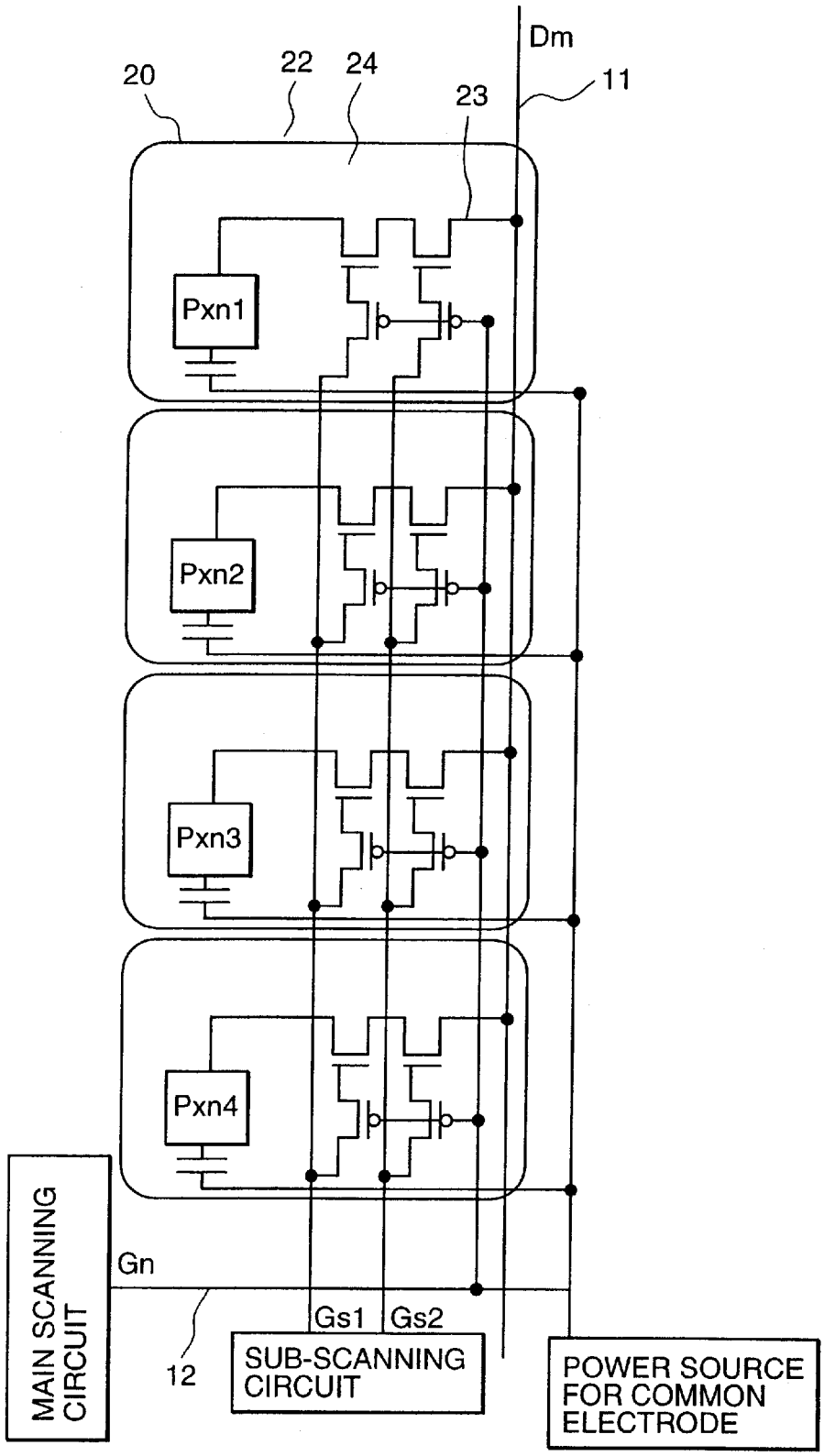

In FIGS. 9 to 11, a third embodiment for the TFT circuit part of the pixel part is shown. In this embodiment, the main circuit of the main scan TFT 22 is connected between the display electrode and the signal wiring line 11, and the main circuit of two sub scan TFT's is connected in series to the gate of the main circuit TFT. For this circuit configuration, the selection pulse on the main scan wiring line 12 controls the main scan TFT to hold it in the ON state when both of two sub scan TFT's are in the ON state, and controls the connection between the display electrode and the signal wiring line. In the second embodiment, though the main scan TFT's for four pixels are connected to the main scan wiring line, and the wiring capacitance is made to increase, the main circuit of the sub scan TFT is connected to the main scan wiring line in this embodiment, and the wiring capacitance of the main scan wiring line can be reduced, and the TFT's can be driven advantageously even if the size of the panel increases and the wiring resistance increases. The signal wiring line and the display electrode are connected through the main scan. TFT, and thus, the ON resistance when driving the pixel can be reduced and the driving of the panel is made faster, and hence the TFT's can be driven faster, in contrast to the case for the second prior art in which the main scan TFT and a couple of sub scan TFT's are connected in series, which results in an advantageous aspect in that pixels with a larger number of scanning lines can be driven.

Figure 12:
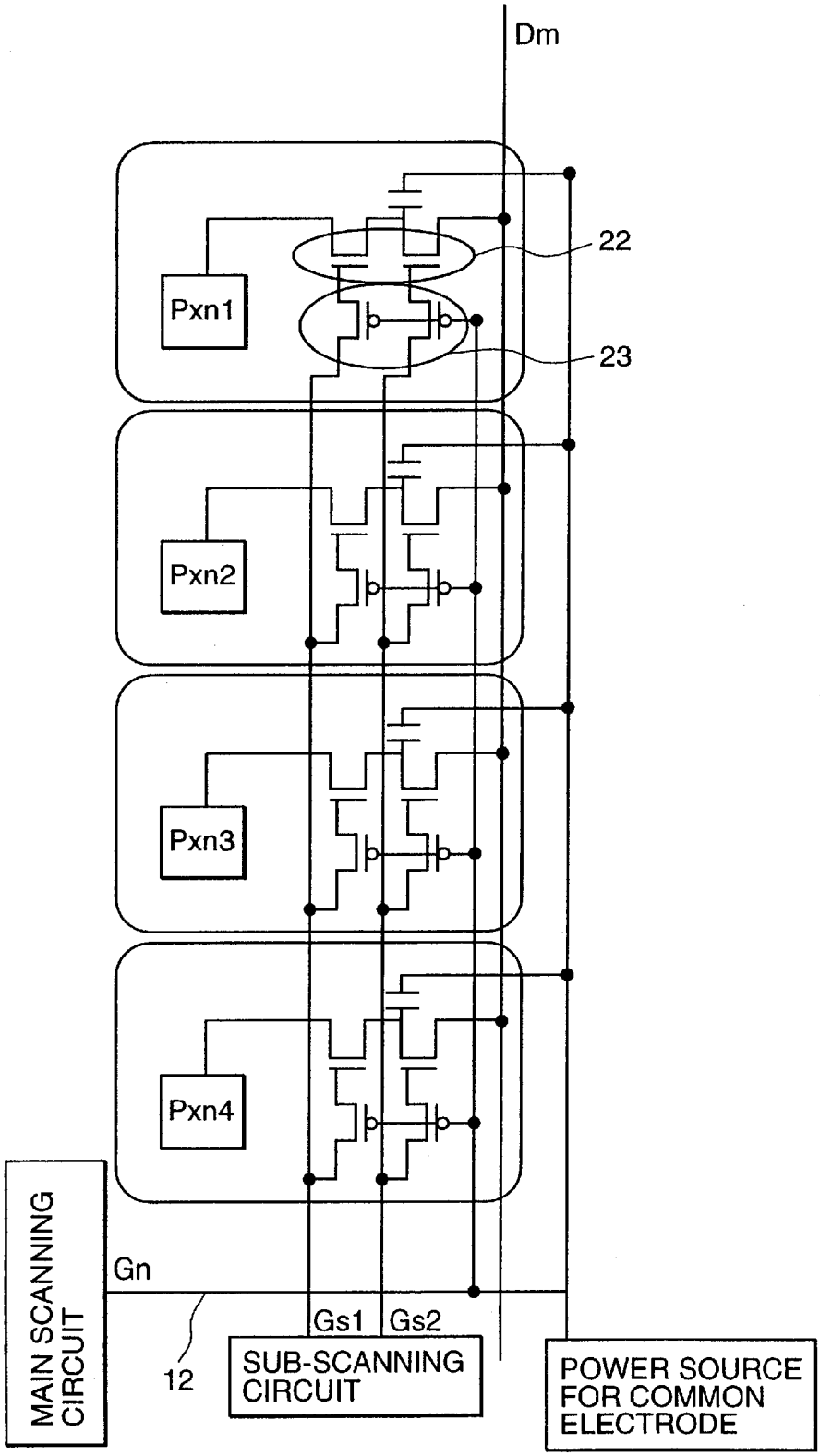
FIG. 12 is a diagram showing a pixel circuit in a fourth embodiment.

Next, a fourth embodiment as shown in FIG. 12 will be described. In this embodiment, in case four TFT's in all including two sub scan TFT's and two main scan TFT's are used, and combinations of the H level and the L level for two sub scan signals and the H level for the main scan wiring line 12 are applied, the individual signal wiring line DM can be selectively connected to the display pixels from px1 to px4 for the pixel part. In this embodiment, in contrast to the second embodiment, what is used is a structure in which the source terminal or the drain terminal forming the main circuit of the sub scan TFT's for the individual pixel is connected to a sub scan wiring line. Since the capacitance of the sub scan wiring line can be reduced and the sub scan signal having a period shorter than that of the main scan wiring line can be transmitted with less waveform distortion, an excellent display image can be advantageously obtained even if the size of the panel is made larger and its definition is made higher. A supplementary capacitance 24 is arranged between two sub scan TFT's, and in a case where the main scan signal maintains the pixel voltage at the L level, the display electrode voltage is maintained and the fluctuation of the liquid crystal drive voltage can be prevented. In contrast to the pixel in the prior art, the sub scan signal is applied periodically while the display electrode voltage level is maintained. As the sub scan signal voltage is used efficiently, there is a benefit in that the noise in the sub scan signal can be reduced efficiently by connecting a supplementary capacitance to the part in the figure where the sub scan TFT's to which two sub scan signals are supplied are commonly connected, and this function is effective for reducing the fluctuation of the display operation.

Figure 18:
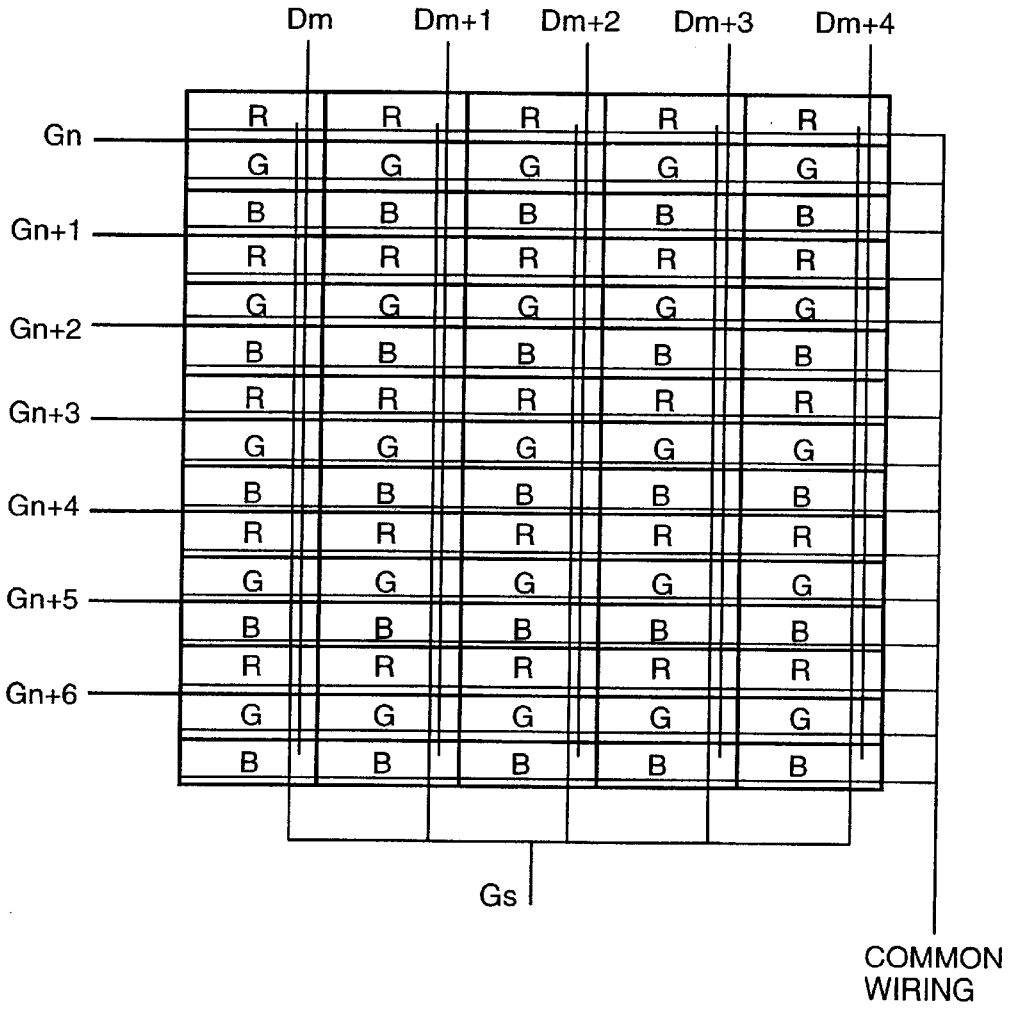
FIG. 18 is a diagram showing an outline of the structure of a horizontally striped-pixel matrix.
Figure 19:
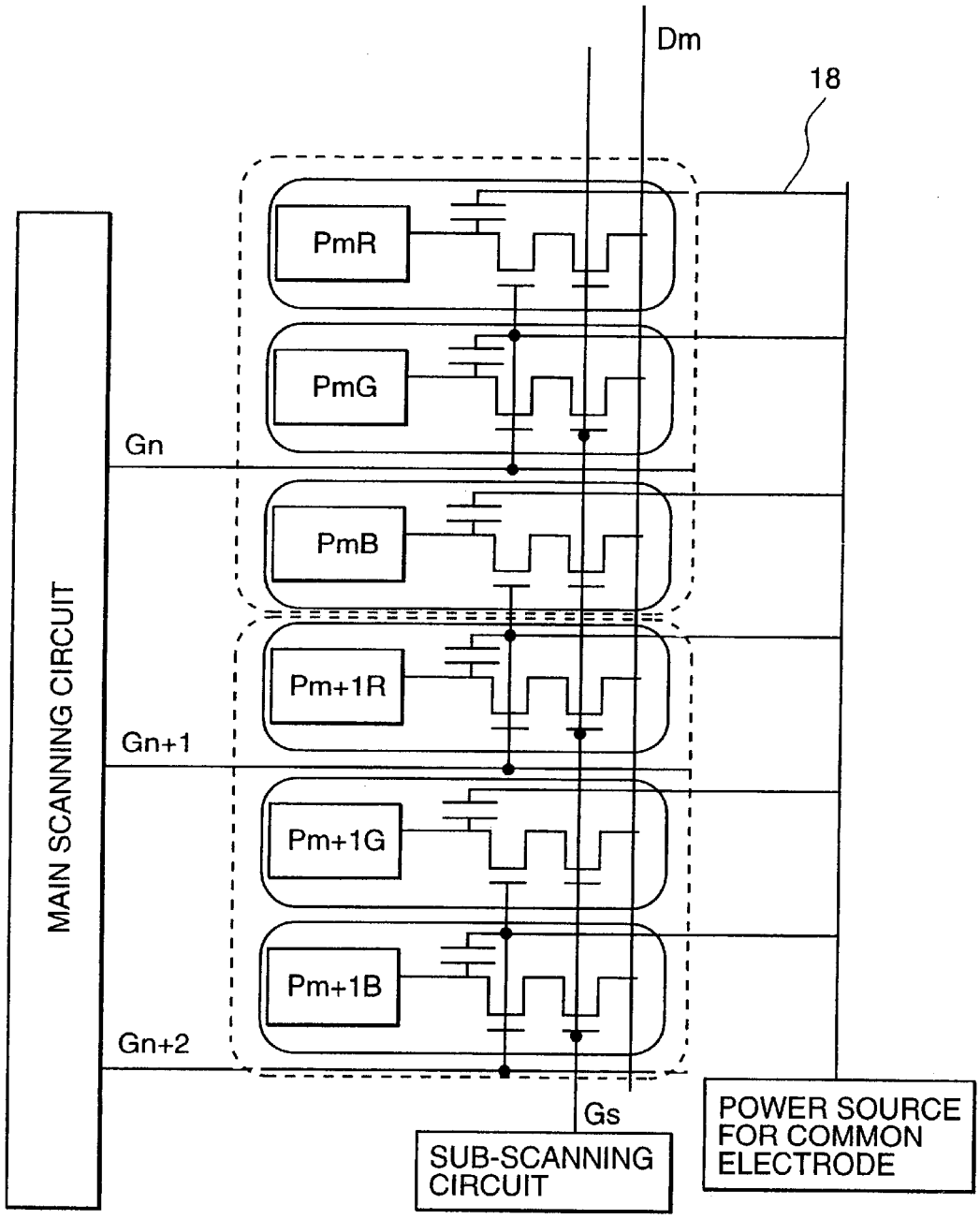
FIG. 19 is a schematic diagram showing an outline of the structure of the horizontally striped pixel circuit.

Next, a fifth embodiment will be described. This embodiment involves a case in which the drive method of the present invention is applied to the pixels formed with the horizontal stripe method and the color filter array method. The relation between the pixel and the scan and signal wiring lines is shown in FIG. 18. A single pixel is assigned for displaying red, green and blue components in the vertical direction. Three cells are arranged in sequence, and the signal wiring line Dm and the sub scan wiring line Gs are arranged for the cell, and the common wiring for the individual cell and the main scan wiring line Gn at intervals of two cells are arranged in the vertical and horizontal directions. The circuit structure of the pixel is shown in FIG. 19. The individual pixel is composed of three cells arranged in the vertical direction, and the main scan wiring line Gn and the common wiring line 18 are arranged for two cells, and the sub scan wiring line Gs and the signal wiring line Dm are arranged for the individual cell in the vertical direction. Since the common electrode wiring is used for providing an identical electric potential to the individual cell for this pixel, it is possible for the common electrode wiring to connect the pixels to one another, and it may connect to the pixels in every column in the vertical direction and may extend outside the matrix in the vertical direction.

Thus, the number of wiring lines required for driving the matrix composed of m pixels in the horizontal direction and n pixels in the vertical direction horizontally by using horizontally striped pixels is shown in Table 1.

TABLE 1

| | PRIOR ART | VERTICAL STRIPE | HORIZONTAL STRIPE COMMON WIRING UP AND DOWN PULLOUT | HORIZONTAL STRIPE COMMON WIRING UP AND DOWN PULLOUT |
|---|---|---|---|---|
| SIGNAL WIRING | 3m | 3m | m | m |
| SUB SCAN WIRING | — | 3m | m | m |
| COMMON WIRING (UP AND DOWN) | — | — | — | m |
| TOTAL OF VERTICAL DIRECTION WIRING | 3m | 6m | 2m | 3m |
| MAIN SCAN WIRING | n | 1/2n | 3/2n | 3/2n |
| COMMON WIRING (LEFT AND RIGHT) | n | n | 3n | — |
| TOTAL OF HORIZONTAL DIRECTION OF WIRING | 2n | 3/2n | 9/2n | 3/2n |

In comparison with the prior art, the number of extraction wiring lines is larger corresponding to the number of sub scan wiring lines. Though, as for the vertical stripe method in accordance with the present invention, the number of wiring lines in the vertical direction is twice as large as that in the prior art. As for the horizontal stripe method, the number of common wiring lines extracted in the vertical direction is 1.5 times as large as that in the prior art, and the number of common wiring lines extracted in the horizontal direction is the same as that in the prior art. Though the number of wiring lines in the horizontal direction formed by the vertical stripe method is 1.5 times larger than that in the prior art and the number of wiring lines in the horizontal direction formed by the horizontal stripe method is 4.5 times larger than that in the prior art, the number of wiring lines extracted to the common electrode in the vertical direction is at most 1.5 larger than that in the prior art. An increase in the number of wiring lines in the pixel cell causes a relative reduction of the open rate of the pixel. As the shape of the cell formed by the vertical stripe method is a rectangle extended in the vertical direction, an increase in the number of wiring lines in the vertical direction contributes to a remarkable decrease in the open rate, but an increase in the number of wiring lines in the horizontal direction does not affect a decrease in the open rate very much. In contrast, since the shape of the pixel formed by the horizontal stripe method is a rectangle extended in the horizontal direction, the less the increase in the number of wiring lines in the horizontal direction is, the less than open rate decreases. The degree of decrease in the open rate of the pixel formed by the vertical stripe method is remarkable in contrast to the pixel in the prior art, but an increase in the number of wiring lines in the horizontal direction, which affects dominantly the open rate, can be limited to be at most 1.5 times larger than that in the prior art by extracting the common wiring lines in the vertical direction with the horizontal stripe method, which leads to the establishment of pixels with a high definition and a high open rate.

Figure 16:
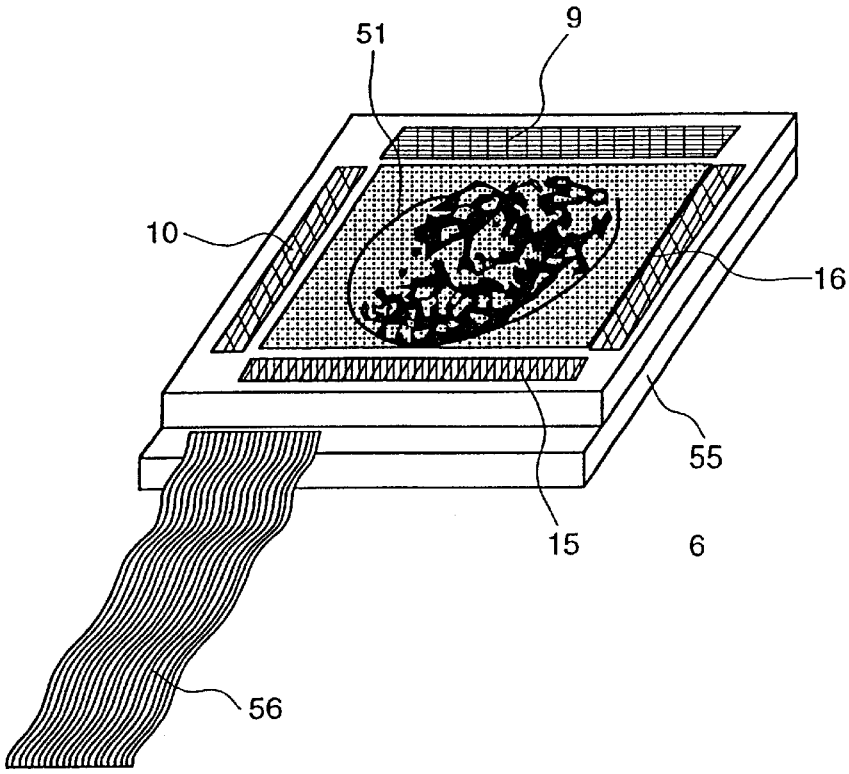
FIG. 16 is a perspective view of an embodiment of the present invention.
Figure 15:
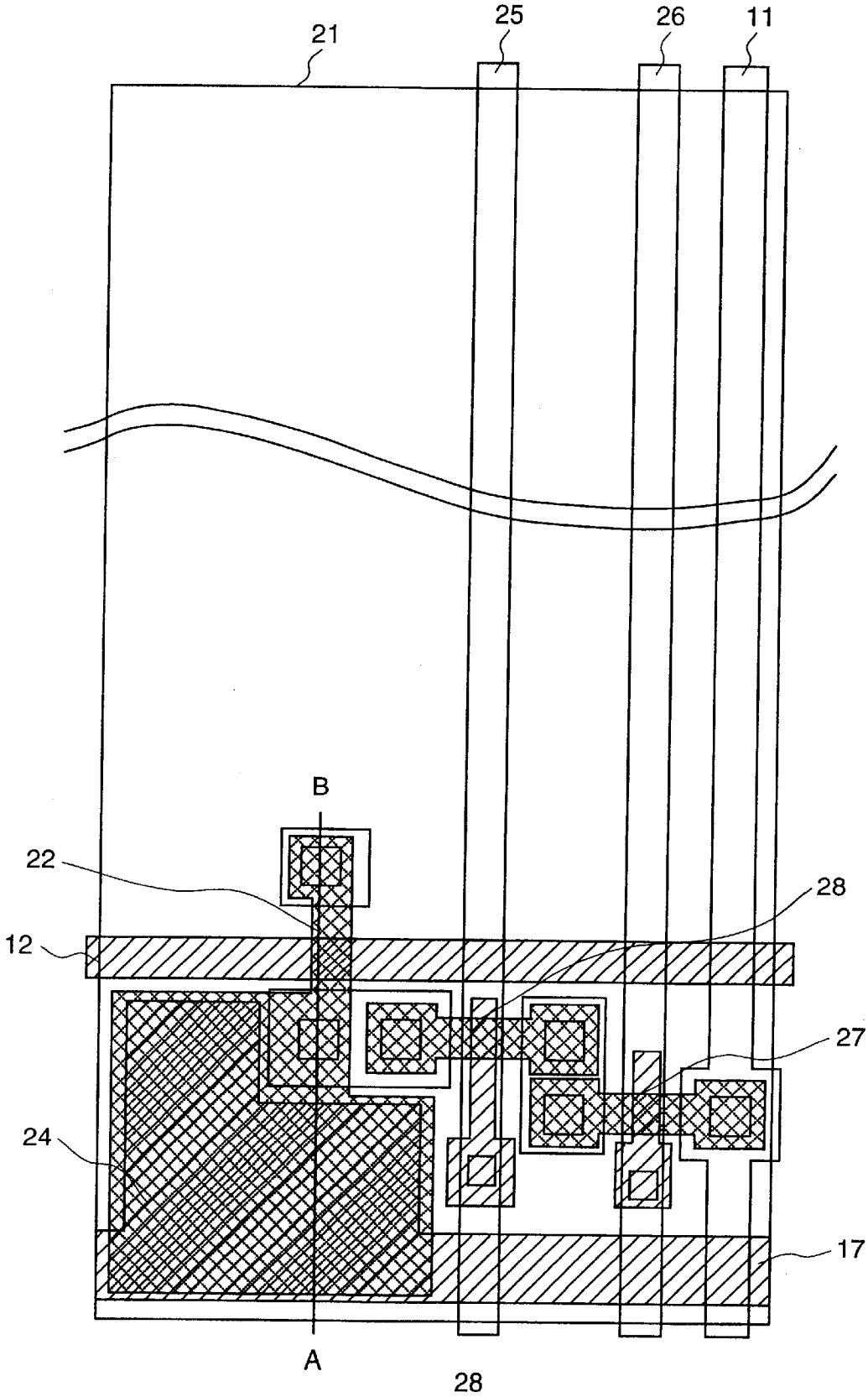
FIG. 15 is a plane view of the pixel part.
Figure 17:
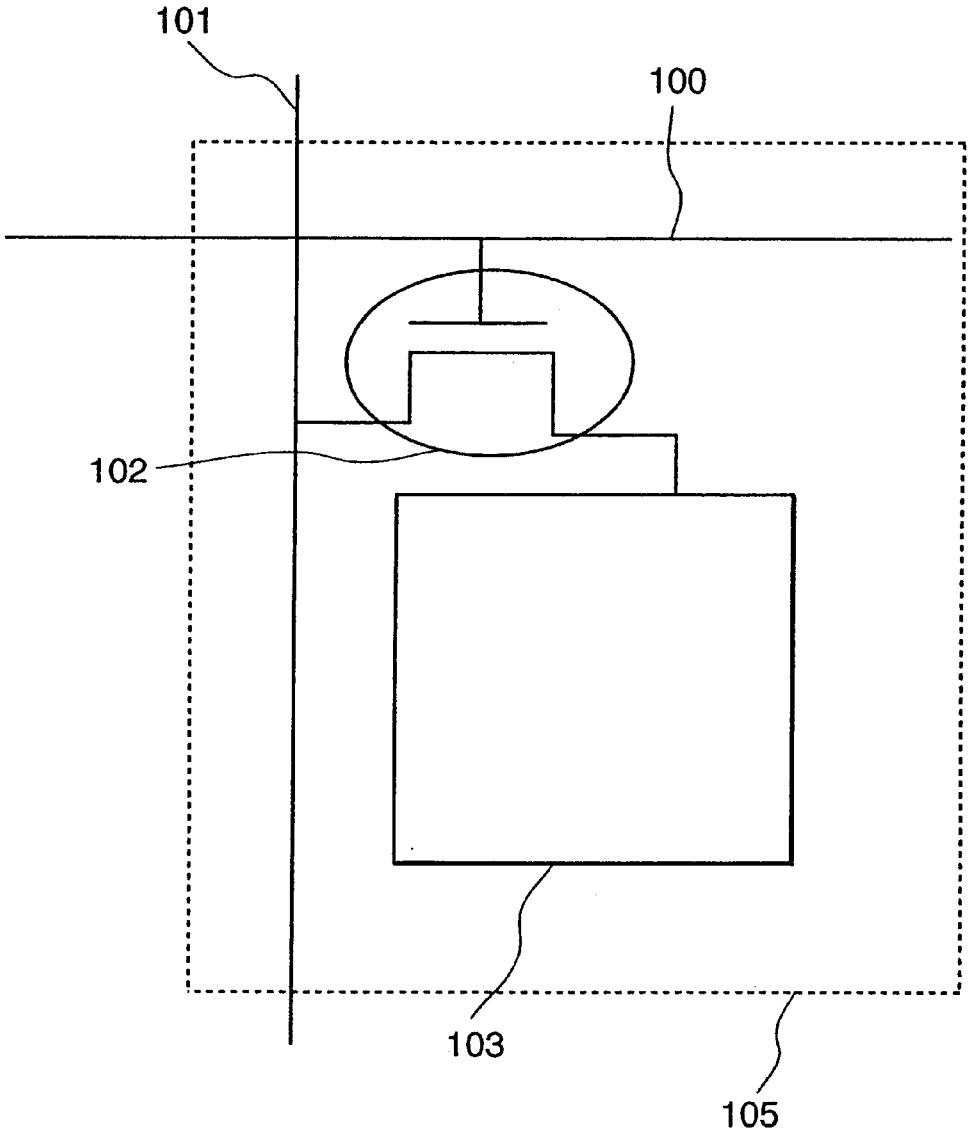
FIG. 17 PRIOR ART
FIG. 17 is a schematic diagram showing an outline of the structure of a liquid crystal display apparatus in the prior art.

FIG. 16 is an external view of the display apparatus described above. The display area 51, in which a number of pixels are arranged in a matrix configuration, the main scan circuit 10, the sub scan circuit 15, the common electrode power supply circuit 16 and the signal circuit 9, to each of which the main scan wiring, the sub scan wiring, the common wiring and the signal wiring extracted from the pixel matrix are connected, are arranged as shown, in which the power supply, the display data and the signals are supplied through the wiring 56 from outside. In a detail description, as the connection pitch with which the wiring lines formed in a matrix configuration are connected to the individual circuits becomes finer due to the high-density display part in the high definition panel, which is recognized as a major effect in the present invention, a display image with high definition and high density can be realized by integrating the drive circuit on the glass substrate 55 by using polysilicon.

In case the size of substrate and the size of pixel is larger, it is possible to integrate the drive circuit onto an LSI and form it by connecting them with an anisotropic conduction layer.

Figure 14:
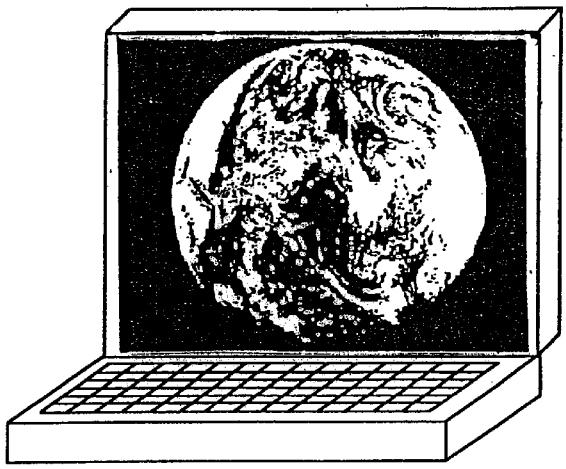
FIG. 14 is a perspective view of a device using the liquid crystal display apparatus of the present invention.

An external view of a personal computer using the liquid crystal display apparatus described above is shown in FIG. 14. Since a display image can be obtained with higher definition than provided by the display apparatus according to the prior art, and the number of pixels can be increased remarkably while using a panel having a similar size to that used in the prior art, so that a photo-quality graphic display with high definition can be provided. Since the peripheral drive parts are integrated on the glass substrate, and the size of the peripheral area around the display part of the display apparatus can made smaller and a more light-weight display apparatus with small number of parts can be realized, a compact and light-weight hand-held computer can be provided.

As described above, according to the present invention, since the pulse width of the main scan pulse to be applied to the main scan wiring is made longer and, therefore, the selection time for the main scan wiring having a longer wire delay can be extended, a uniform and excellent display characteristic can be established without sacrificing the display quality, while providing a display which is free from flicker.

In addition to the above effect, since the writing time for the signal wire can be increased by increasing the number of signal wiring lines so as to provide two for a single line, the display gradation accuracy can be increased, and thus, a display image with a more excellent display quality can be provided.

By forming the pixels in a horizontal stripe arrangement and extracting the common wiring lines in the vertical direction, a display apparatus having a higher open rate and a reduced electric power consumption can be obtained.

According to the present invention, a liquid crystal display apparatus enabling a high quality display can be provided.

What is claimed is:

1. A liquid crystal display apparatus, comprising:

plural main scan wiring lines;

signal wiring lines arranged so as to intersect with the plural main scan wiring lines;

a display matrix having one or more sub scan wiring lines arranged along the plural signal wiring lines;

plural pixels arranged in a column direction in an area partitioned by the main scan wiring lines and the signal wiring lines, the plural pixels being formed with plural pixel TFT devices; and a display electrode;

wherein one end of a main circuit of the plural pixel TFT devices is connected to a display electrode in a corresponding pixel, and its other end is connected to a signal wiring line;

wherein at least one of the gate electrodes of the plural pixel TFT devices is connected to a main scan wiring line, and the remaining gate electrodes are connected to an identical sub scan wiring line in a row direction; and wherein the liquid crystal apparatus further comprises:

a main scan circuit for selecting and driving sequentially the main scan wiring lines, and a sub scan circuit for driving the sub scan wiring line;

a signal circuit for supplying an image signal to the signal wiring lines in synchronization with a main scan signal and a sub scan signal; and an opposed substrate power circuit for applying a voltage to an opposed electrode facing plural display electrodes and supporting a liquid crystal;

wherein a pair of TFT devices are connected to a signal wiring line and a display electrode by a series connection, and one of the gate electrodes of the pair of TFT devices is connected to a main scan wiring line assigned to every two pixels in a row direction, and the other gate electrode thereof is connected to the sub scan wiring line assigned to a single signal wiring line; and wherein a row of pixels are selected and driven in response to a main scan signal and a sub scan signal.

2. A liquid crystal display apparatus according to claim 1, wherein three TFT devices are connected in each pixel to the signal wiring lines and the display electrode by a series connection; and wherein a main scan wiring line is provided for four rows of pixels, and the polarity of the three TFT devices is defined by repetitive and cyclic use of patterns, Nch-Nch-Nch, Nch-Nch-Pch, Nch-Pch-Nch and Nch-Pch-Pch, wherein each Nch device at the first one of the gate electrodes of the three TFT devices is connected in common to the main scan wiring line, while, for the other two TFTs, the second ones have their gates connected to each other and the third ones have their gates connected to each other, and then each is connected individually to respective ones of two sub scan wiring lines.

* * * * *